US007302072B2

(12) United States Patent
Skillicorn

(10) Patent No.: US 7,302,072 B2
(45) Date of Patent: Nov. 27, 2007

(54) ELECTRONIC DEVICE MOUNT FOR MASK

(75) Inventor: Greg Skillicorn, Grainger Township, OH (US)

(73) Assignee: Ultra Electronics AudioPack Inc., Garfield Heights, OH (US)

( * ) Notice: Subject to any disclaimer, the term of this patent is extended or adjusted under 35 U.S.C. 154(b) by 274 days.

(21) Appl. No.: 10/846,203

(22) Filed: May 14, 2004

(65) Prior Publication Data

US 2005/0008183 A1 Jan. 13, 2005

Related U.S. Application Data

(60) Provisional application No. 60/471,206, filed on May 16, 2003.

(51) Int. Cl.
*A62B 18/08* (2006.01)
*H04R 1/08* (2006.01)

(52) U.S. Cl. ..... 381/364; 381/366; 128/201.19; 2/422

(58) Field of Classification Search ..... 381/367, 381/364, 370, 384, 376, 375, 91, 366, 385; 455/575.4, 100, 575.1, 90.3, 575.9, 545, 455/344, 348, 350, 351, 575.6; 379/430, 379/453; 181/21; 128/201.19; 2/422; 84/743
See application file for complete search history.

(56) References Cited

U.S. PATENT DOCUMENTS 2,416,411 A * 2/1947 Sharbaugh et al. .... 128/201.19
2,530,383 A * 11/1950 Estes et al. ..... 381/58
2,586,851 A * 2/1952 Monro et al. ..... 128/201.19
3,180,333 A * 4/1965 Lewis ..... 128/201.19
3,184,556 A * 5/1965 Larkin ..... 379/430
4,508,936 A * 4/1985 Ingalls ..... 128/201.19
5,224,474 A * 7/1993 Bloomfield ..... 381/367
5,463,693 A 10/1995 Birli et al.
5,566,362 A 10/1996 Bauer et al.
6,179,666 B1 * 1/2001 Osborn ..... 439/669
6,382,206 B1 * 5/2002 Palazzotto et al. ..... 128/201.19
6,430,298 B1 * 8/2002 Kettl et al. ..... 381/361
6,608,908 B1 * 8/2003 Galet et al. ..... 381/376

* cited by examiner

*Primary Examiner*—Daniel Swerdlow
(74) *Attorney, Agent, or Firm*—Fay Sharpe LLP; Brian E. Turung

(57) ABSTRACT

An adapter assembly for releasably supporting lapel mic on a mask includes a mask adapter for mounting on the mask, and a lapel adapter for mounting on the lapel mic. The lapel adapter is releasably connectable with the mask adapter to support the lapel mic on the mask. The adapter assembly has a sound opening that enables sound to pass from a voice emitter of the mask to the microphone of the lapel mic. The lapel connector of the lapel mic is accessible through the adapter assembly when the adapter assembly is connected with the lapel mic. The invention also relates to a method comprising the steps of attaching a lapel adapter to a lapel mic, attaching a mask adapter to a mask, and connecting the lapel mic to the mask.

35 Claims, 7 Drawing Sheets

ELECTRONIC DEVICE MOUNT FOR MASK

RELATED APPLICATIONS

This application claims the benefit of U.S. Provisional Application No. 60/471,206 filed May 16, 2003, the entire disclosure of which is incorporated by reference.

FIELD OF THE INVENTION

The invention relates generally to communication systems, and more particularly, to mask-based communications. In particular, the invention relates to the mounting of a hand-held (or non-mask-supported) electrical device, such as a lapel mic (microphone), on a mask, so that a mask wearer can communicate electronically.

BACKGROUND OF THE INVENTION

Protective gas masks or face masks provide breathing capabilities while protecting the mask user from noxious gases, smoke, etc. People wearing the masks often have a need to communicate with one another, particularly during emergency situations. To this end, police, fire, emergency medical service, security and military personnel often carry two-way radios as standard issue equipment. The two way radio often has connected to it a lapel mic, which is a microphone-speaker assembly hardwired to the radio with a coiled wire for releasable connection to the user's clothing via a lapel clip or lapel connector. Wearing a conventional gas mask or face mask in emergency situations can make the use of such standard issue two-way radios difficult or impossible because the masks cover, among other things, the wearer's mouth. Thus, the user's voice can not get out of the mask to the microphone of the male microphone. Alternatively, the user has to manually hold the lapel mic adjacent a voice emitter port of the mask.

SUMMARY OF THE INVENTION

The present invention relates to an adapter assembly for use with a lapel mic that has a microphone and a speaker. The adapter assembly is for releasably supporting the lapel mic on a mask. The adapter assembly comprises a mask adapter for mounting on the mask, and a lapel adapter for mounting on the lapel mic. The lapel adapter is releasably connectable with the mask adapter to support the lapel mic on the mask.

The invention also relates to an adapter assembly for use with a lapel mic that has a lapel connector for releasably supporting the lapel mic on a wearer's lapel and that has a microphone and a speaker. The adapter assembly is for releasably supporting the lapel mic on a mask. The adapter assembly has a sound opening that enables sound to pass from the mask through the adapter assembly to the microphone of the lapel mic when the lapel mic is supported by the adapter assembly on the voice emitter port of the mask. The lapel connector of the lapel mic is accessible through the adapter assembly when the adapter assembly is connected with the lapel mic.

The invention also relates to apparatus comprising a mask having a voice emitter, a lapel mic having a lapel connector for releasably connecting the lapel mic to an article of clothing of a user, and an adapter assembly for releasably connecting the lapel mic with the mask. The lapel mic is alternatively connectable either with the mask by the adapter assembly or with the article of clothing by the lapel connector.

The invention also relates to a method comprising the steps of attaching a lapel adapter to a lapel mic, attaching a mask adapter to a mask, and connecting the lapel mic to the mask.

DETAILED DESCRIPTION OF ILLUSTRATED EMBODIMENTS

Figure 1:
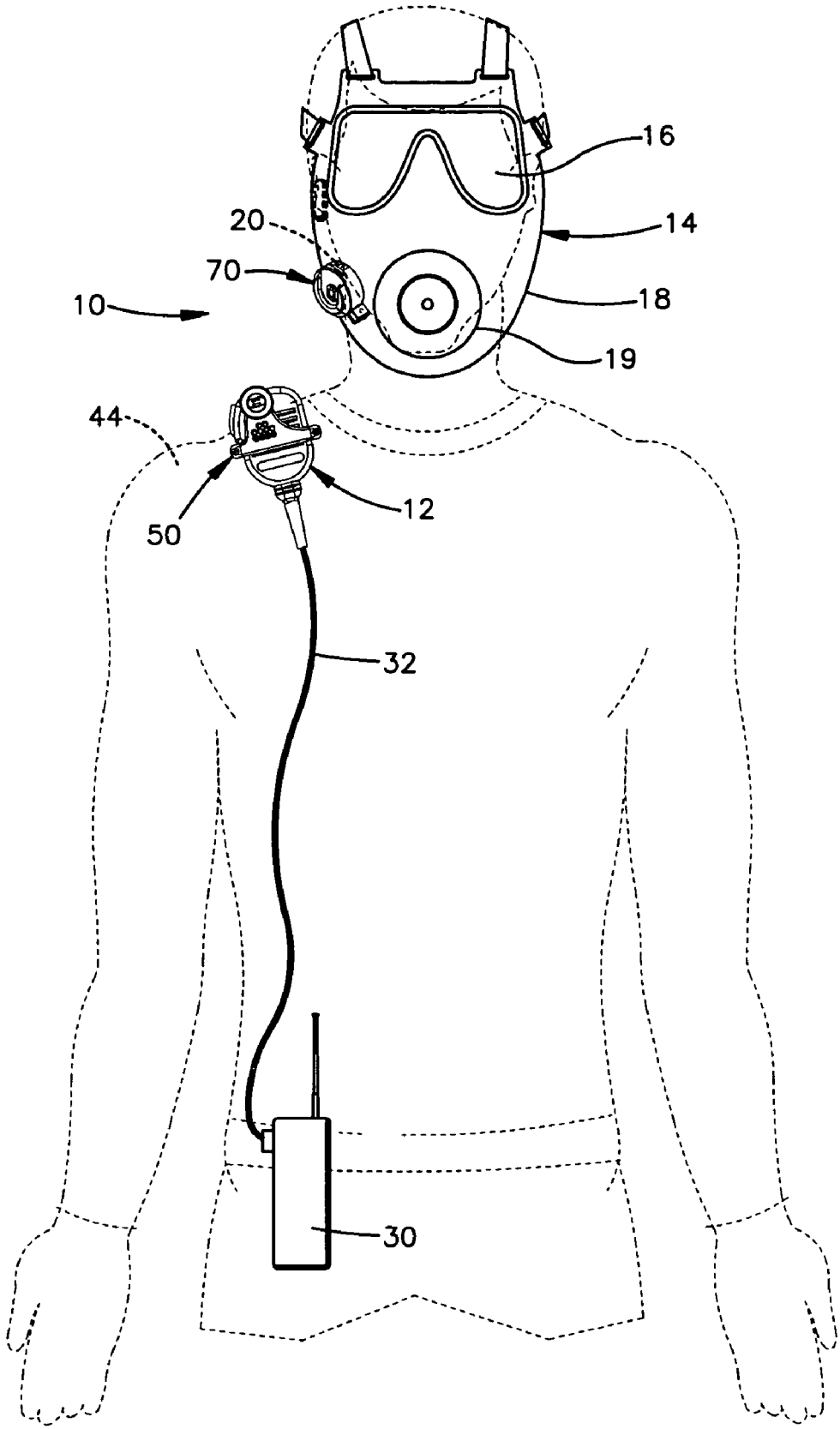
FIG. 1 is a schematic view showing an adapter assembly in accordance with a first embodiment of the invention, shown in use on a user with the lapel mic being supported on the user's lapel or other article of clothing.
Figure 2:
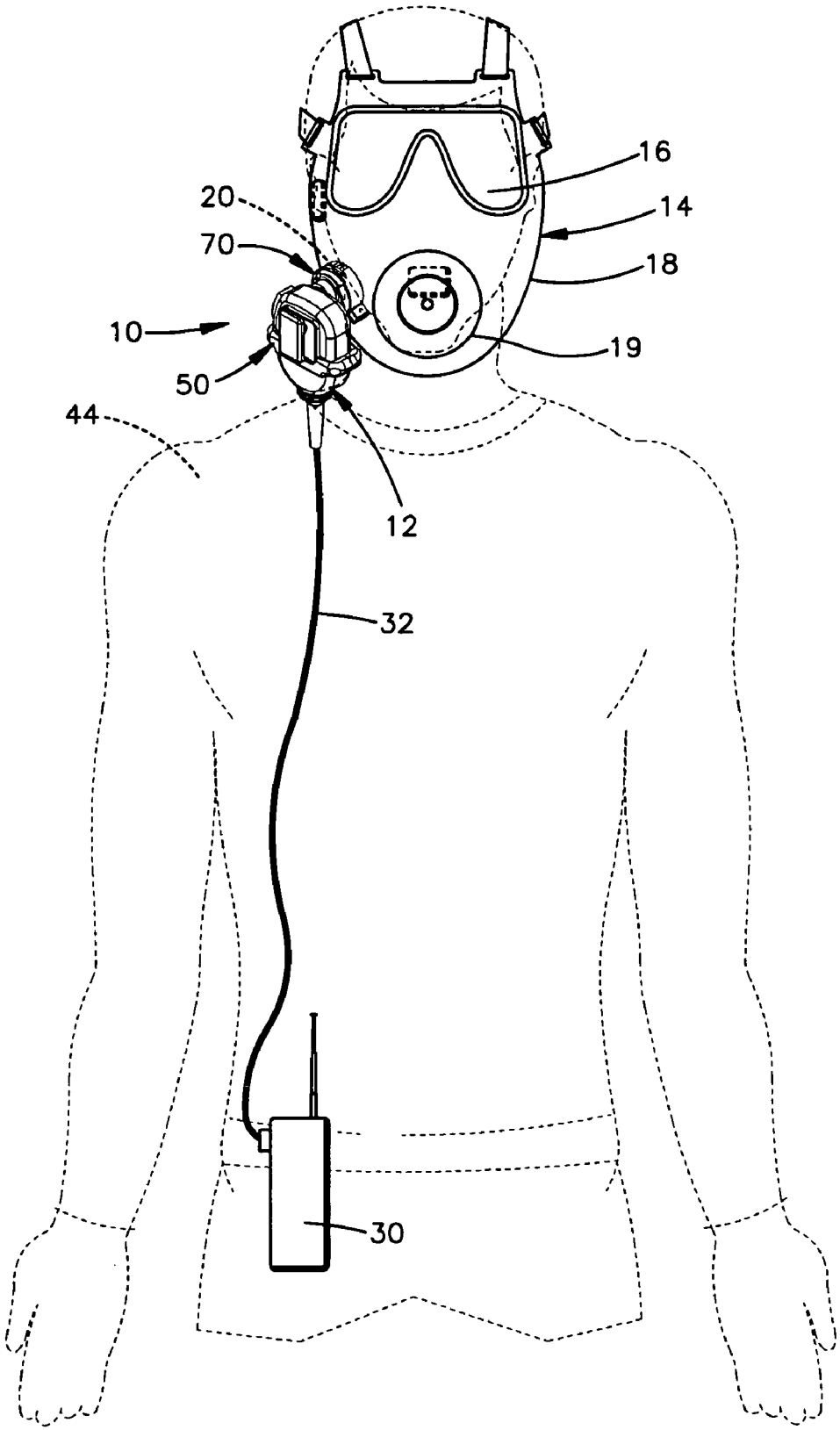
FIG. 2 is a schematic view similar to FIG. 1 showing the adapter assembly of FIG. 1 in use on a user with the lapel mic being supported on the user's mask.
Figure 4:
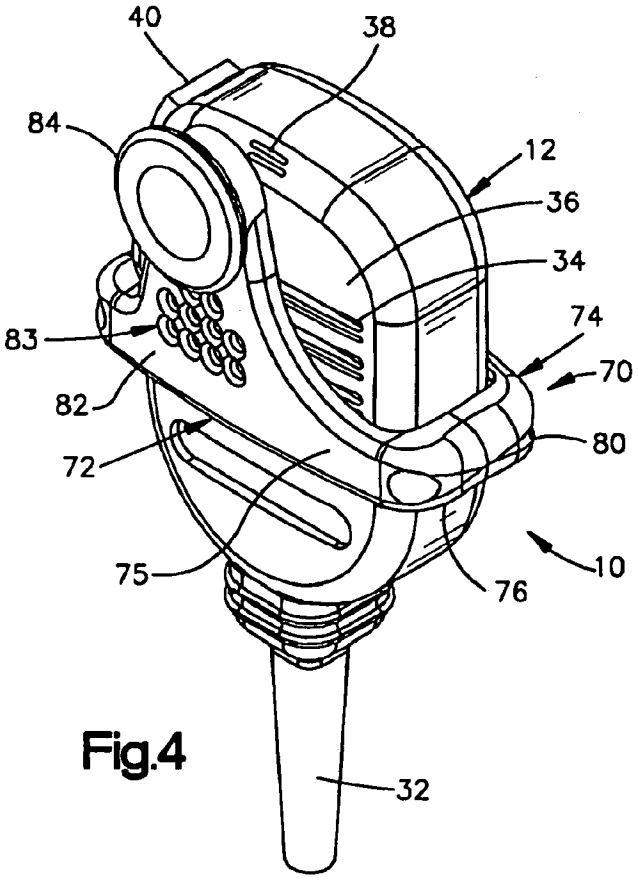
FIG. 4 is a perspective view of a lapel adapter that forms part of the adapter assembly of FIG. 1, shown mounted on the lapel mic.

The invention relates generally to communication systems, and more particularly, to mask-based communications. In particular, the invention relates to the mounting of a hand-held (or non-mask-supported) electrical device, such as a lapel mic, on a mask, to facilitate mask communication. The invention is applicable to mask communication devices of various types, including adapter assemblies for supporting lapel mics on masks, of various different types and constructions. The invention is not limited to the following description or the illustrated embodiments.

As representative of the invention, FIGS. 1–7 illustrate an adapter assembly 10 in accordance with a first embodiment of the invention, for supporting a lapel mic 12 on a mask 14. The mask 14 has a lens 16 through which the user can see. The mask 14 is coupled to the user's face by a seal 18 around the outside of the lens 16. The mask 14 covers the user's nose and mouth. The mask 14 has a breathing port 19 through which fresh air or oxygen can be admitted to the mask.

Figure 3:
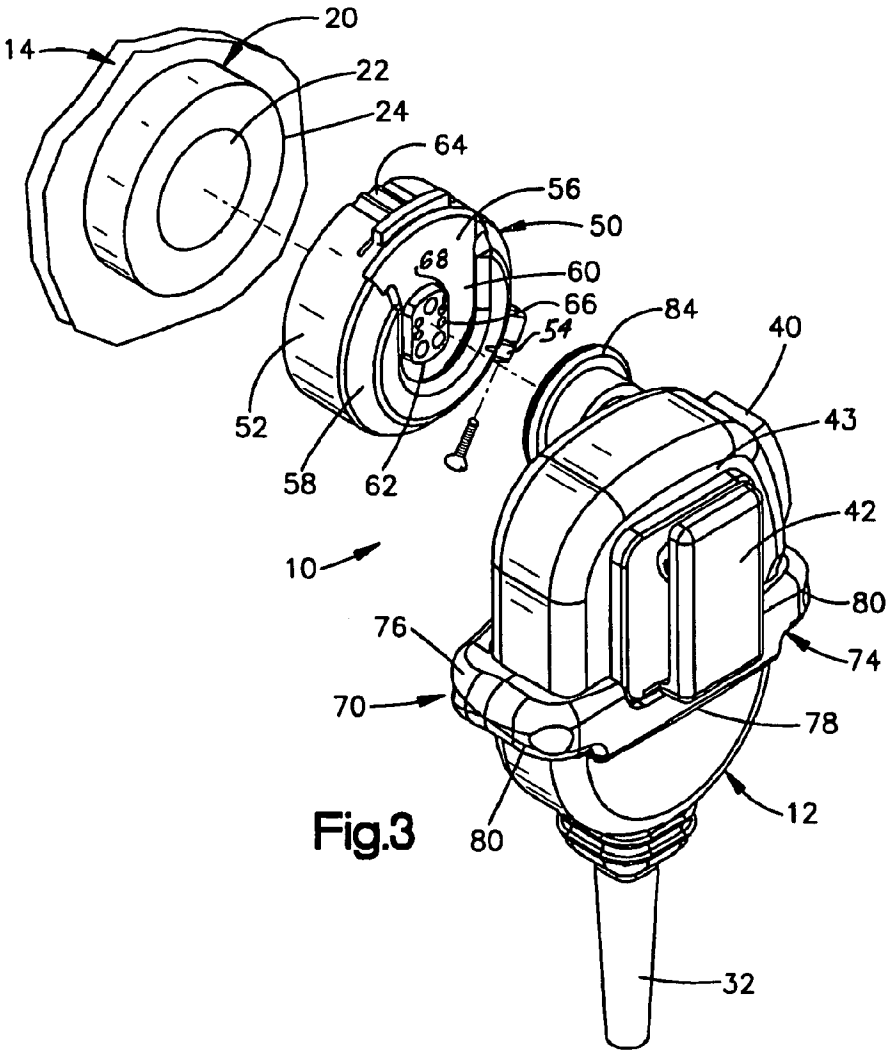
FIG. 3 is an exploded perspective view of the adapter assembly of FIG. 1.
Figure 6:
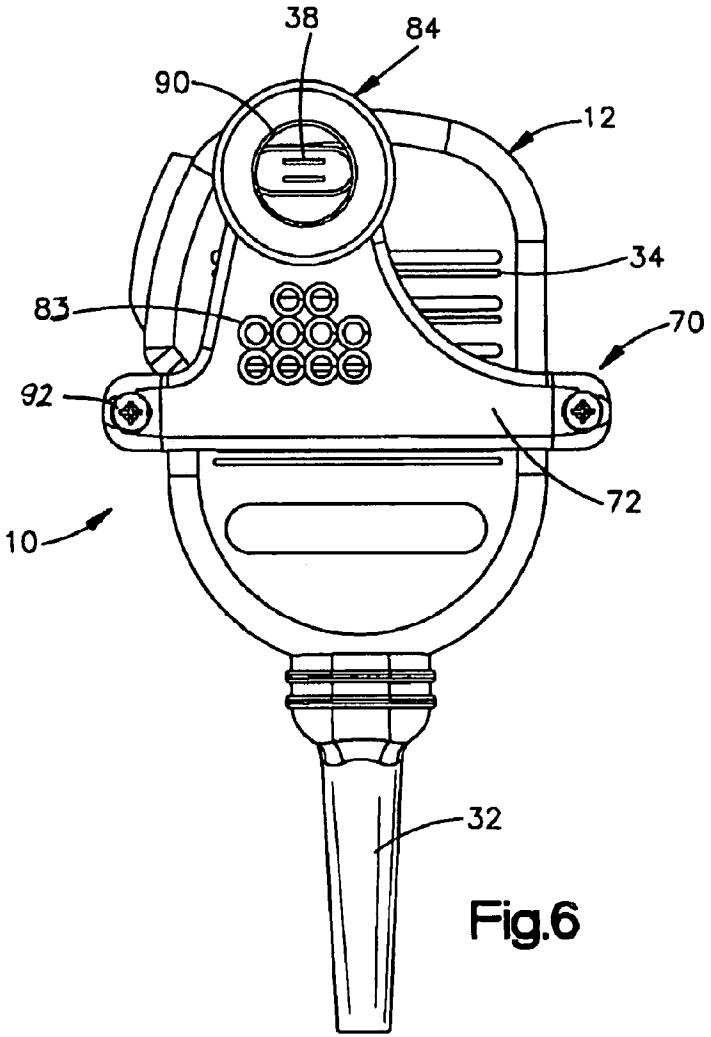
FIG. 6 is an elevational view of the lapel adapter on the lapel mic.
Figure 5:
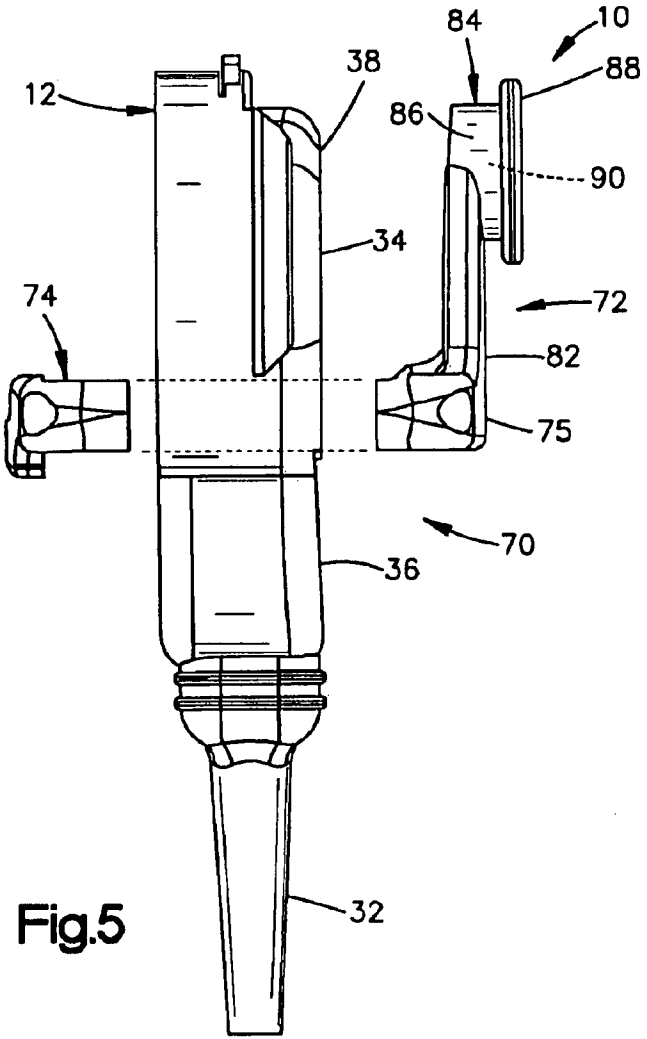
FIG. 5 is a side elevational view of the lapel adapter and the lapel mic.

The mask 14 (FIGS. 1–3) also has one or more voice emitter ports 20. Each voice emitter port 20 includes an opening in the mask 14 that is sealed by a diaphragm 22 through which the user's voice can be projected to the outside of the mask. The voice emitter port 20 is surrounded by a circular closure member 24 (FIG. 3).

The lapel mic 12 is a known device that is attached to a walkie talkie 30 by, for example, a coiled wire 32. The lapel mic 12 may alternatively have a wireless link with the walkie talkie 30. The lapel mic 12 has a speaker grille (opening) 34 along its front major side surface 36, through which incoming signals to the lapel mic are broadcast for the user to hear. The lapel mic 12 has a microphone 38 which is located typically at an upper corner of the lapel mic, at the edge of the front surface 36. The microphone 38 picks up the user's voice and transmits it through the coiled wire 32. The lapel mic 12 also has a push to talk button 40, typically on a side of the lapel mic. The lapel mic 12 further includes a belt clip or lapel clip 42 which is a known clip on the back major side surface 43 for attaching the lapel mic to, for example, a lapel or pocket of other item 44 of the wearer's clothing as shown in FIG. 1.

The adapter assembly 10 as illustrated in FIGS. 1–7 includes two components: a mask adapter 50 and a lapel adapter 70. As described below, the mask adapter 50 is a device that attaches to the mask 14. The lapel microphone adapter or lapel adapter 70 is a device that attaches to the lapel mic 12. The lapel (microphone) adapter 70 is releasably engageable with the mask adapter 50 to support the lapel mic 12 on the mask 14, while the lapel mic still can be attached (alternatively) to the user's clothing 44 in the usual manner with the lapel clip 42. The adapter assembly 10 thus enables the lapel mic 12 to be connected with, or attached to, or supported on, the mask 14. This attachment is preferably, though not necessarily, adjacent the voice emitter 20. This attachment enables the user's voice as transmitted through the mask to be captured by the microphone 38 of the lapel mic. As a result, a mask wearer can communicate electronically using existing equipment.

The mask adapter 50 has a main body portion 52 that clamps onto or is otherwise secured to the voice emitter port 20. For example, the mask adapter 50 may be secured to the voice emitter port by a screw clamp 54. A mask adapter in accordance with the invention could have a different configuration or construction and could be connected with another part of a mask, for example, a part other than the voice emitter.

The mask adapter 50 has a slot 56 that opens upward when the mask adapter is installed on the mask 14 and the mask is in use. The slot 56 is defined by a wall portion 58 of the mask adapter 50 that is spaced outwardly from the main body portion 52 with the slot between them. There is a generally U-shaped opening 60 into the slot 56. The mask adapter 50 has a latch 62 adjacent the slot 56, and a latch release member 64 that is manually engageable to release the latch.

The mask adapter 50 has a sound opening 66 through which sound from the voice emitter 20 can pass to a location outside the mask 14 and outside the mask adapter. In the illustrated embodiment, the sound opening 66 is formed as a plurality of small openings 68.

The lapel adapter 70 in the illustrated embodiment includes a first part 72 and a second part 74. A lapel adapter in accordance with the invention could have a different configuration or construction.

The first part 72 of the lapel adapter 70 has an elongate bar portion 75 with bent end portions 76 for engaging the second part 74. The second part 74 of the lapel adapter 70 has an elongate bar portion 78 with bent end portions 80 for engaging the end portions 76 of the first part 72 and for receiving fasteners.

The first part 72 of the lapel adapter 70 has a body portion 82 that extends upward (as viewed in FIG. 4) from the bar portion 75 and that has a sound opening 83 in it. The body portion 82 supports a projecting hub 84 that includes a hollow stem portion 86 and an annular disc portion 88. The hub 84 thus has a sound opening 90 through which sound can pass. The disc portion 88 is configured to fit into the slot 56 in the mask adapter 50.

The first part 72 of the lapel adapter 70 fits around the front surface 36 of the lapel mic 12. The second part 74 of the lapel adapter 70 fits around the back surface 43 of the lapel mic 12. The first and second parts 72 and 74 of the lapel adapter 70 are secured to each other by fasteners 92, such as a pair of screws, through their respective end portions 76 and 80.

When the lapel adapter 70 is thus mounted on the lapel mic 12, the sound opening 90 in the first part 72 of the lapel adapter overlies the speaker grille 34 of the lapel mic 12, so that the sound from the speaker can still be heard by the user even though the lapel adapter is secured to the lapel mic.

The hub 84 of the lapel adapter 70 is aligned with (overlies) the microphone 38 of the lapel mic 12. As a result, the user's voice can still be directed into the microphone 38 of the lapel mic 12, through the sound opening 90 in the hub 84 of the lapel adapter 70, even though the lapel adapter is secured to the lapel mic.

In addition, neither the first part 72 nor the second part 74 of the lapel adapter 70 covers the lapel clip 42 of the lapel mic 12, as can be seen from FIG. 3. The open space around the second part 74 of the lapel adapter 70 constitutes an opening through which the lapel clip is accessible. (A differently constructed lapel adapter might have a different type of opening, for example, one bounded on all sides.) Thus, the lapel clip 42 can still be used to clip the lapel mic 12 to the user's clothing 44 even though the lapel adapter is secured to the lapel mic. The push to talk switch 40 is also accessible even though the lapel adapter 70 is secured to the lapel mic 12

When the user wants to support the lapel mic 12 on the lapel 44 or other article of clothing, the lapel clip 42 is used for that purpose. The lapel clip 42 is accessible through the lapel adapter 70 and can be clipped onto a lapel, a shirt pocket, or another portion of the user's clothing, for example.

When the lapel mic 12 is clipped on with the lapel clip 42, the hub 84 projects outward, away from the user. The microphone 38 and speaker opening 34 of the lapel mic 12 are unobstructed by the lapel adapter 70. Also, the push to talk switch 40 is accessible for operation in the normal manner.

When the user wants to support the lapel mic 12 on the mask 14, in order to communicate when wearing a mask, the lapel mic is unclipped from the lapel 44. The assembly of the lapel adapter 70 and lapel mic 12 is then brought into position adjacent the voice emitter port 20 of the mask 14. The hub 84 on the lapel adapter 70 is slipped into the slot 56 on the mask adapter 50. The latch 62 on the mask adapter 50 engages the hub 84 of the lapel adapter 70, to secure the lapel adapter to the mask adapter.

When the adapter assembly 10 is in this assembled condition, the sound opening 90 in the hub 84 of the lapel adapter 70 aligns with, or overlies, the sound opening 66 in the mask adapter 50. As a result, sound from the voice emitter 20 can pass through the sound opening 66 in the mask adapter 50, through the sound opening 90 in the lapel adapter 70, and into the microphone 38 of the lapel mic 12. Therefore, the user's voice is transmitted into the microphone 38 of the lapel mic 12, and the lapel mic is usable in the same manner as when it is on the lapel 44. At the same time, sound from the speaker grille 34 can pass through the sound opening 83 in the lapel adapter 70, to the wearer.

When the adapter assembly 10 is in this assembled condition, the hub 84 of the lapel adapter 70 can swivel in the slot 56 of the mask adapter 50. As a result, the lapel mic 12 can swivel with respect to the mask 14, and so will not drag on the coil cord 32, for example. Also, the swivel connection enables the lapel mic 12 to be attached to a voice emitter port 20 on either side of the mask 14, or to another portion of the mask.

When the user thereafter wants to have the lapel mic 12 on the lapel 44, the user actuates the latch release button 64, the latch 62 is released, and the user can lift the lapel adapter 70 out of the slot 56 in the mask adapter 50. The lapel mic 12 comes off the mask 14 along with the lapel adapter 70, and the assembly of the lapel mic and the lapel adapter can be hand held again or can be clipped to the clothing 44, for example.

Figure 7:
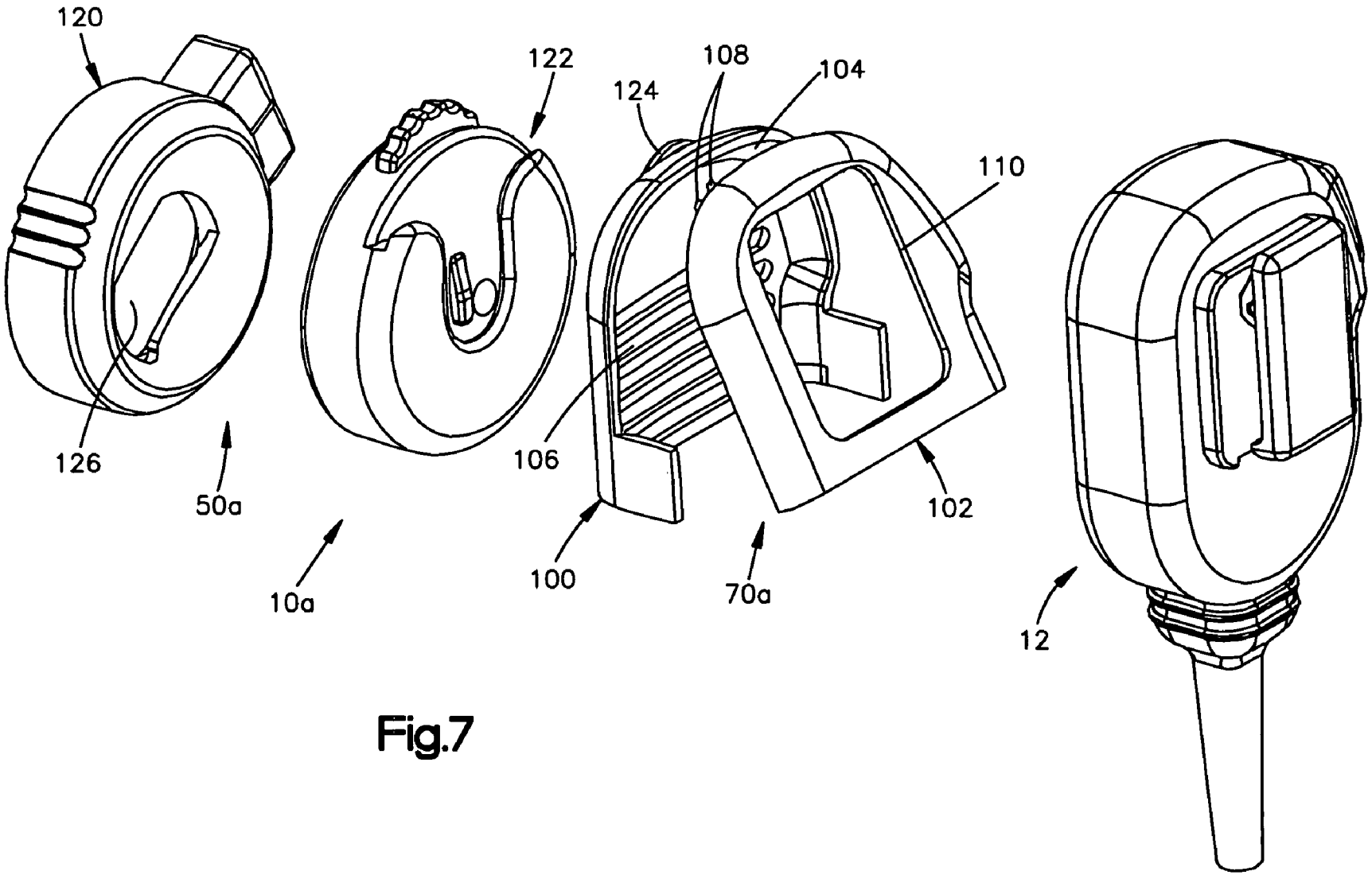
FIG. 7 is an exploded perspective view of an adapter assembly in accordance with a second embodiment of the invention, shown associated with a lapel mic.
Figure 8:
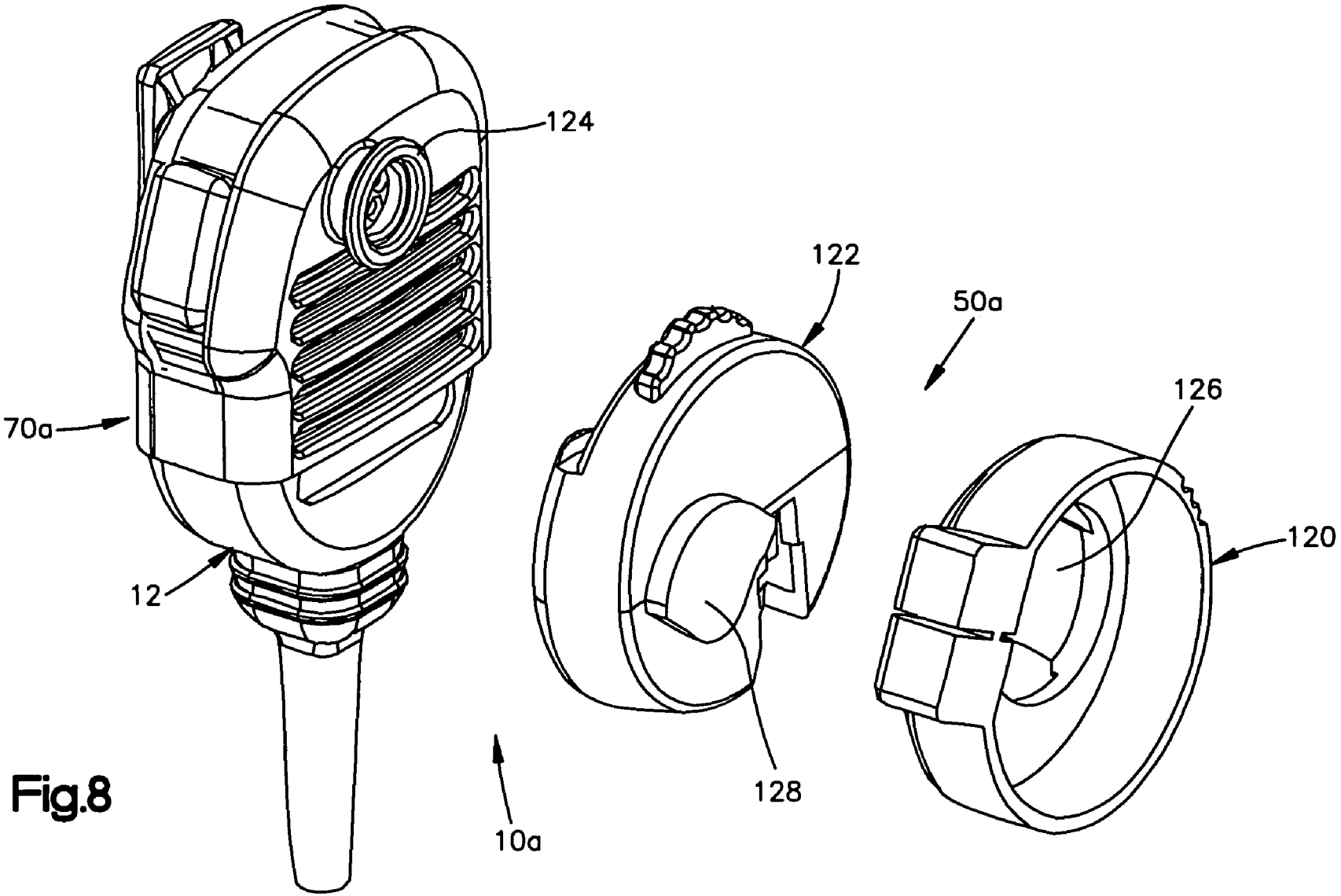
FIG. 8 is another exploded perspective view of the adapter assembly of FIG. 7, with the lapel adapter mounted on the lapel mic.

FIGS. 7 and 8 illustrate an adapter assembly 10*a* in accordance with a second embodiment of the invention. The adapter assembly 10*a* of the second embodiment is adapted to mount to the same lapel mic 12 and mask 14. The second embodiment illustrates, among other things, that the invention can be used with a known mask connector.

The lapel adapter 70*a* shown in FIGS. 7 and 8 is a one piece device rather than two pieces. The lapel adapter has a generally clamshell configuration including a first portion 100 and a second portion 102 joined by a hinge 104. The first portion 100 extends over the speaker side of the lapel mic 12 and has an opening or openings 106 for the speaker grille of the lapel mic 12. The first portion 100 also has an opening or openings 108 for the microphone of the lapel mic 12. The second portion 102 of the lapel adapter 70*a* extends over the back and has an opening 110 for the lapel clip.

The mask adapter 50*a* shown in FIGS. 7 and 8 is a two piece device rather than a one piece device. Thus, the mask adapter 50*a* has a first portion 120 that is adapted to be secured to a mask, and a second portion 122 that is adapted to receive a hub 124 of the lapel adapter 70*a*. The first portion 120 of the mask adapter 50*a* has a D-shaped opening 126 that is of the type used in some standard (known) mask connections, for example, for voice amplifiers. The second portion 122 of the mask adapter 50*a* has a D-shaped hub 128 that is adapted to fit into the D-shaped opening 126 with a known turn-and-lock action.

Thus, when the first portion 120 of the mask adapter 50*a* is on the mask, the mask either can receive the second portion 122 of the mask adapter and the lapel mic 12, or can receive another known device, such as a voice amplifier.

Figure 10:
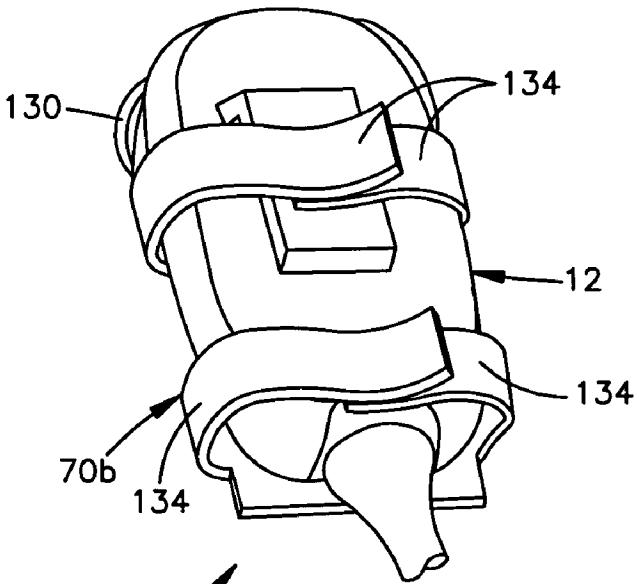
FIG. 10 is a view of the adapter assembly of FIG. 9 assembled with the lapel mic.
Figure 9:
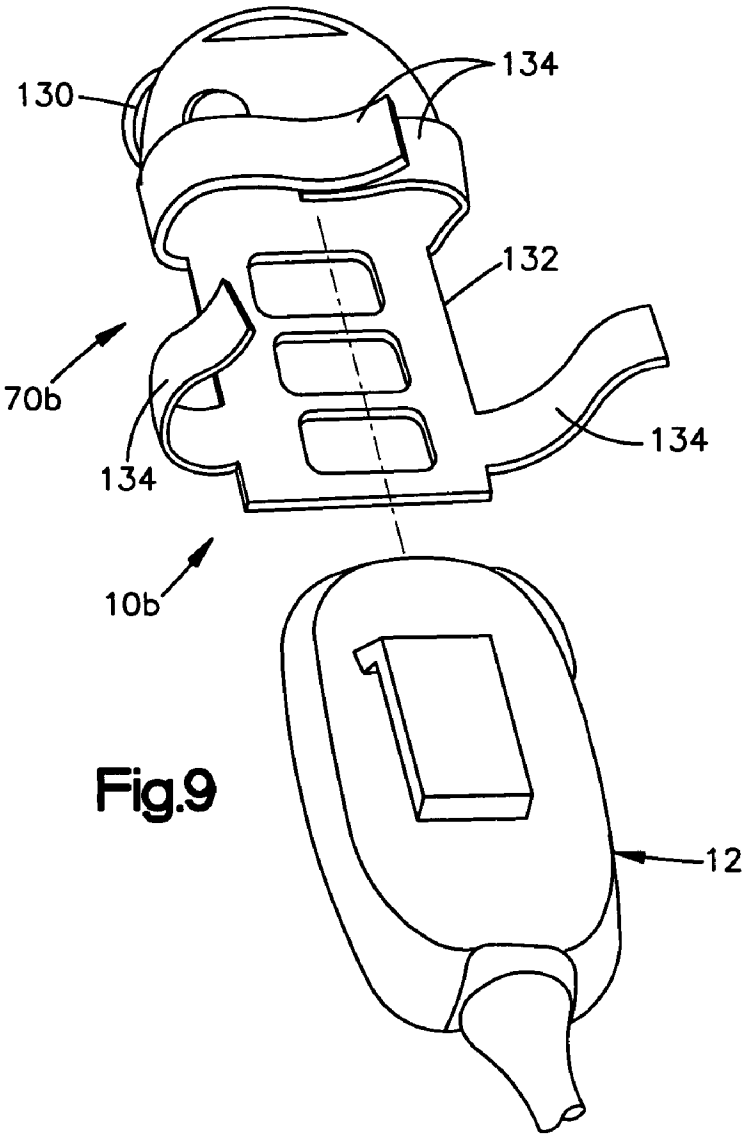
FIG. 9 is a perspective view of an adapter assembly in accordance with a third embodiment of the invention shown associated with a lapel mic.

FIGS. 9 and 10 illustrate an adapter assembly 10*b* in accordance with a third embodiment of the invention. The adapter assembly 10*b* of the second embodiment is adapted to mount to the same lapel mic 12 and mask 14.

The adapter assembly 10*b* includes a lapel adapter 70*b* that is a one piece device having a D-shaped hub 130 similar to that of the mask adapter 50*a* of FIGS. 7 and 8. As a result, the lapel adapter 70*b* can mount directly to, for example, the first portion 102 of the mask adapter 50*a* shown in FIG. 7. The lapel adapter 70*b* is a one-piece unit that is basically a plate 132 with straps 134 to hold it onto the lapel mic 12. On the back is the D-shaped hub 130.

Having described the invention, I claim:

1. An adapter assembly designed to releasably connect a lapel mic to a mask, said lapel mic including a housing and a microphone at least partially contained in the housing, said adapter assembly including a mask adapter and a lapel adaptor, said mask adaptor designed to be secured to the mask, said lapel adapter designed to be secured to the housing of the lapel mic, said lapel adapter including a first connector designed to releasably connect to a lapel connector on said mask adapter while said mask adaptor is secured to the mask and said lapel adaptor is secured to said lapel mic, said mask adaptor and said lapel adaptor causing the lapel mic to be spaced outward from an inner region of the mask when said lapel mic is releasably connected to said mask adaptor.

2. The adapter assembly as defined in claim 1, wherein said mask adaptor and said lapel adaptor causing the lapel mic to be spaced outward from an outer surface of the mask when said lapel mic is releasably connected to said mask adaptor.

3. The adapter assembly as defined in claim 2, wherein said lapel adaptor includes a second connector designed to releasably secure to a clothing article worn by an operator, said first and second connector having different configurations.

4. The adapter assembly as defined in claim 3, wherein said second connector is positioned in a different location on said lapel adaptor from said first connector, said second connector accessible to an operator when said lapel adapter is releasably connected to said mask adapter.

5. The adapter assembly as defined in claim 4, wherein said lapel adaptor, said mask adaptor, or combinations thereof include at least one sound opening designed to facilitate in sound passing by sound waves between said mask and the microphone of said lapel mic when said mask adaptor is secured to the mask and said lapel adaptor is secured to said lapel mic and said lapel adapter is releasably connect to said mask adapter.

6. The adapter assembly as defined in claim 5, wherein said lapel adaptor and said mask adaptor include at least one sound opening.

7. The adapter assembly as defined in claim 6, wherein said mask adaptor is designed to be connected to a voice emitter port in the mask.

8. The adapter assembly as defined in claim 7, wherein said mask adaptor includes a latch arrangement designed to releasably lock said first connector to said lapel connector.

9. The adapter assembly as defined in claim 8, wherein said lapel adaptor includes a body portion that at least partially encircles a housing of the lapel mic, said body portion including a first and second members, said first member including said first connector and said second member including said second connector.

10. The adapter assembly as defined in claim 9, wherein said first connector and said second members positioned on different sides of the housing of the lapel mic when said lapel adaptor is connected to the lapel mic.

11. The adapter assembly as defined in claim 10, wherein said first member includes at least one sound opening positioned closely adjacent to a speaker opening in the housing of the lapel mic.

12. The adapter assembly as defined in claim 11, wherein said first connector includes at least one microphone opening, said microphone opening designed to at least partially overlie the microphone of said lapel mic when said lapel adaptor is connected to the lapel mic.

13. The adapter assembly as defined in claim 12, wherein said at least one microphone opening in said first connector at least partially aligned with at least one sound opening in said mask adaptor when said lapel adapter is releasably connect to said mask adapter.

14. The adapter assembly as defined in claim 13, wherein said lapel connector on said mask adaptor allows that said first connector on said lapel adaptor to at least partially swivel relative to said mask adaptor when said lapel adapter is releasably connect to said mask adapter.

15. The adapter assembly as defined in claim 1, wherein said lapel adaptor includes a second connector designed to releasably secure to a clothing article worn by an operator, said first and second connector having different configurations.

16. The adapter assembly as defined in claim 15, wherein said second connector is positioned in a different location on said lapel adaptor from said first connector, said second connector accessible to an operator when said lapel adapter is releasably connected to said mask adapter.

17. The adapter assembly as defined in claim 15, wherein said lapel adaptor includes a body portion that at least partially encircles a housing of the lapel mic, said body portion including a first and second members, said first member including said first connector and said second member including said second connector.

18. The adapter assembly as defined in claim 17, wherein said first connector and said second members positioned on different sides of the housing of the lapel mic when said lapel adaptor is connected to the lapel mic.

19. The adapter assembly as defined in claim 17, wherein said first member includes at least one sound opening positioned closely adjacent to a speaker opening in the housing of the lapel mic.

20. The adapter assembly as defined in claim 19, wherein said first connector includes at least one microphone opening, said microphone opening designed to at least partially overlie the microphone of said lapel mic when said lapel adaptor is connected to the lapel mic.

21. The adapter assembly as defined in claim 20, wherein said at least one microphone opening in said first connector at least partially aligned with at least one sound opening in said mask adaptor when said lapel adapter is releasably connect to said mask adapter.

22. The adapter assembly as defined in claim 1, wherein said lapel adaptor, said mask adaptor, or combinations thereof include at least one sound opening designed to facilitate in sound passing by sound waves between said mask and the microphone of said lapel mic when said mask adaptor is secured to the mask and said lapel adaptor is secured to said lapel mic and said lapel adapter is releasably connect to said mask adapter.

23. The adapter assembly as defined in claim 22, wherein said lapel adaptor and said mask adaptor include at least one sound opening.

24. The adapter assembly as defined in claim 1, wherein said mask adaptor is designed to be connected to a voice emitter port in the mask.

25. The adapter assembly as defined in claim 1, wherein said lapel connector on said mask adaptor includes slot designed to receive at least a portion of said first connector on said lapel adaptor.

26. The adapter assembly as defined in claim 25, wherein said slot includes a U-shaped opening.

27. The adapter assembly as defined in claim 1, wherein said mask adaptor includes a latch arrangement designed to releasably lock said first connector to said lapel connector.

28. The adapter assembly as defined in claim 1, wherein said lapel connector on said mask adaptor allows that said first connector on said lapel adaptor to at least partially swivel relative to said mask adaptor when said lapel adapter is releasably connect to said mask adapter.

29. A method of releasably connecting a lapel mic to a mask comprising:

a) providing a mask adapter that is designed to be secured to the mask, said mask adapter including a lapel connector;

b) securing said mask adaptor to a voice emitter port in the mask;

c) providing a lapel adaptor designed to be secured to the lapel mic, said lapel mic including a housing that at least partially includes a microphone, said lapel adaptor including a body designed to be at least partially secured to the housing of said lapel mic, said lapel adapter including a first connector designed to releasably connect to said lapel connector on said mask adapter;

d) securing said lapel adaptor to said housing of said lapel mic;

e) releasably connecting said lapel adaptor to said mask adaptor by releasably connecting together said first connector to said lapel connector, said lapel mic being spaced outward from an inner region of said mask when said lapel mic is releasably connected to said mask and said first connector to said lapel connector are connected together.

30. The method as defined in claim 29, wherein said lapel mic being spaced outward from an outer surface of said mask when said lapel mic is releasably connected to said mask and said first connector to said lapel connector are connected together.

31. The method as defined in claim 29, wherein said lapel adaptor includes a second connector designed to releasably secure to a clothing article worn by an operator, said first and second connector having different configurations.

32. The method as defined in claim 31, wherein said second connector is positioned in a different location on said lapel adaptor from said first connector, said second connector accessible to an operator when said lapel adapter is releasably connected to said mask adapter.

33. The method as defined in claim 31, wherein said mask adaptor and said lapel adaptor are connected to enable the two adaptors to at least partially swivel relative to one another when said lapel adapter is releasably connect to said mask adapter.

34. The method as defined in claim 29, wherein said lapel adaptor, said mask adaptor, or combinations thereof include at least one sound opening designed to facilitate in sound passing by sound waves between said mask and the microphone of said lapel mic when said mask adaptor is secured to the mask and said lapel adaptor is secured to said lapel mic and said lapel adapter is releasably connect to said mask adapter.

35. The method as defined in claim 29, including the step of releasably locking said mask adaptor to said lapel adaptor.

* * * * *